US006537088B2

(12) United States Patent
Huang

(10) Patent No.: US 6,537,088 B2
(45) Date of Patent: Mar. 25, 2003

(54) PLUG RECEPTACLE PROTECTION COVER CONTAINING INTERMEDIATE FLEXIBLE ELEMENT

(75) Inventor: Chyong-yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 62 days.

(21) Appl. No.: 09/906,100

(22) Filed: Jul. 17, 2001

(65) Prior Publication Data

US 2003/0017731 A1 Jan. 23, 2003

(51) Int. Cl.[7] ..... H01R 13/44
(52) U.S. Cl. ..... 439/137; 439/145
(58) Field of Search ..... 439/137–140, 439/136, 142, 145, 135, 147, 153, 155, 172, 195, 188, 259, 261

(56) References Cited

U.S. PATENT DOCUMENTS 4,600,258 A * 7/1986 Hu ..... 439/137
4,867,693 A * 9/1989 Gizienski ..... 439/137
4,867,694 A * 9/1989 Short ..... 439/137
5,006,075 A * 4/1991 Bowden, Jr. ..... 439/137

* cited by examiner

*Primary Examiner*—Neil Abrams
*Assistant Examiner*—J. F. Duverne
(74) *Attorney, Agent, or Firm*—Rosenberg, Klein & Lee

(57) ABSTRACT

A plug receptacle protection cover containing an intermediate flexible element, having an intermediate space to accommodate a protection cover at the bottom corresponding to two outlets of the plug receptacle; slops provided on both sides the protection cover corresponding to said two outlets and a secondary outlet each to respectively match said two outlets is provided at the bottom of said intermediate space; a saddle between two outlets in the intermediate space to receive a perforated portion protruding from the center of the protection cover, a flexible element installed between the protection cover and the saddle, and a guide in the intermediate space to direct the protection to travel in a given direction.

8 Claims, 19 Drawing Sheets

PLUG RECEPTACLE PROTECTION COVER CONTAINING INTERMEDIATE FLEXIBLE ELEMENT

BACKGROUND OF THE INVENTION

1. Field of the Invention

The present invention relates to a plug receptacle containing an intermediate flexible element, and more particularly to one having the flexible element provided in the central portion of the protection cover for saving installation space, providing sensitive and balanced flexibility to facilitate movement by the protection cover and faster assembly of the plug receptacle.

2. Description of the Prior Art

Some of the plug receptacles available in the market are provided with protection covers for the outlets. These protection covers relate to a slide having an outlet or space separately provided on the cover to allow passage by a plug and pin. The cover is provided on the bottom layer of the outlet of the plug receptacle and is separately applied with a restoration force by a flexible element. Under normal conditions, a substantial part of the cover keeps the outlet from sight to prevent ingression of dust and humidity into the receptacle. Upon receiving a plug, the cover is pushed to hold against the flexible element for the opening or the space in the cover to slide below the outlet and admit the pin of the plug. Once the plug leaves the receptacle, the outlet is hidden again by the cover subject to the force applied by the flexible element. However, the flexible element of the prior art being placed by or beneath the cover consumes a large space, prevents easy installation, and is vulnerable to unbalanced flexibility resulting in poor sliding.

SUMMARY OF THE INVENTION

The primary purpose of the present invention is to provide a plug receptacle protection cover containing an intermediate flexible element. To achieve the purpose, the flexible element used to push against the cover is provided in the central portion of the cover, instead of by or beneath it, to reduce the installation space as a whole. The present invention also eliminates flexible push askew to achieve more consistent sliding by the cover, and the use of a single piece of cover with intermediate flexible element allows compact assembly of members and easy assembly.

DETAILED DESCRIPTION OF THE PREFERRED EMBODIMENTS

Figure 1:
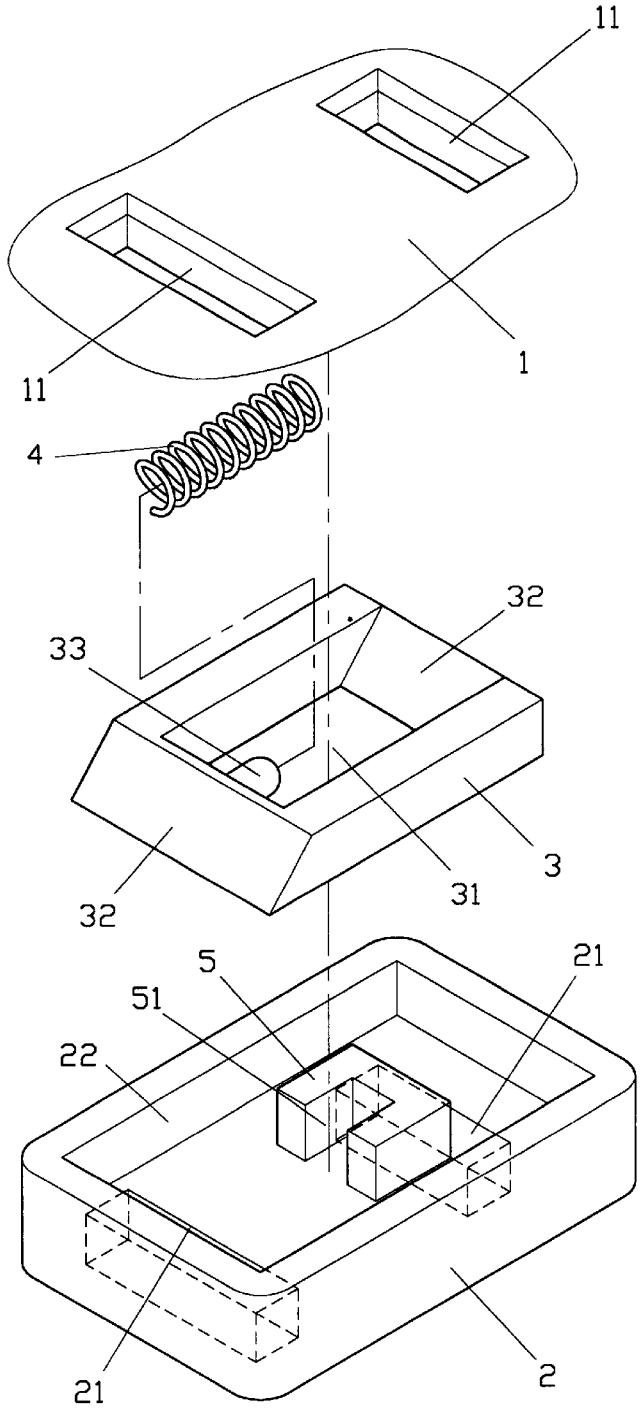
FIG. 1 is an exploded view showing a basic configuration of the present invention.

Referring to FIG. 1, a plug receptacle protection cover of the present invention is essentially comprised of an upper lid (1) having two outlets (11) in it; a lower base (2) provided above the conductive plates and having two secondary outlets (21) corresponding to the outlets (11), an intermediate space comprised of an upper lid (1) and a lower base (2), and a protection cover (3) with a flexible element (4) accommodated in the intermediate space.

The cover (3) relates to a frame with a perforated portion (31) in its central portion. The length of the longer side of the cover (3) is approximately equal to that of the outer edge of the outlets (11) of the upper lid (1), and its shorter side is slightly longer than the longest side of the outlets (11). Slopes (32) are provided on both shorter sides of the cover (3) and corresponds to the outlets (11) of the upper lid (1). As illustrated in the first embodiment of the present invention in FIG. 1, a saddle (5) is provided between the two outlets (11) (i.e., between the secondary outlets (21)) in the intermediate space (i.e., inside the lower base (2). The perforated space (31) formed in the central portion of the cover (3) is slightly larger than the saddle (5) so that the cover (3) can be covered onto the saddle (5). The flexible element (4) which contains a length smaller than the length between the two outlets (11), is provided between the saddle (5) and the cover (3). A protrusion (33) and a trough (51) are provided to the cover (3) and the saddle (5) for both ends of the flexible element (4) to be fixed in position. The side walls (22) of the intermediate space in parallel with the sides of the cover (3) or the edge of the saddle (5) (i.e., inner wall of the lower base (2) as illustrated in FIG. 1), can form a proper guide to hold against the cover (3) so that the cover (3) can slide in a given direction in relation to the flexible element (4).

Figure 2:
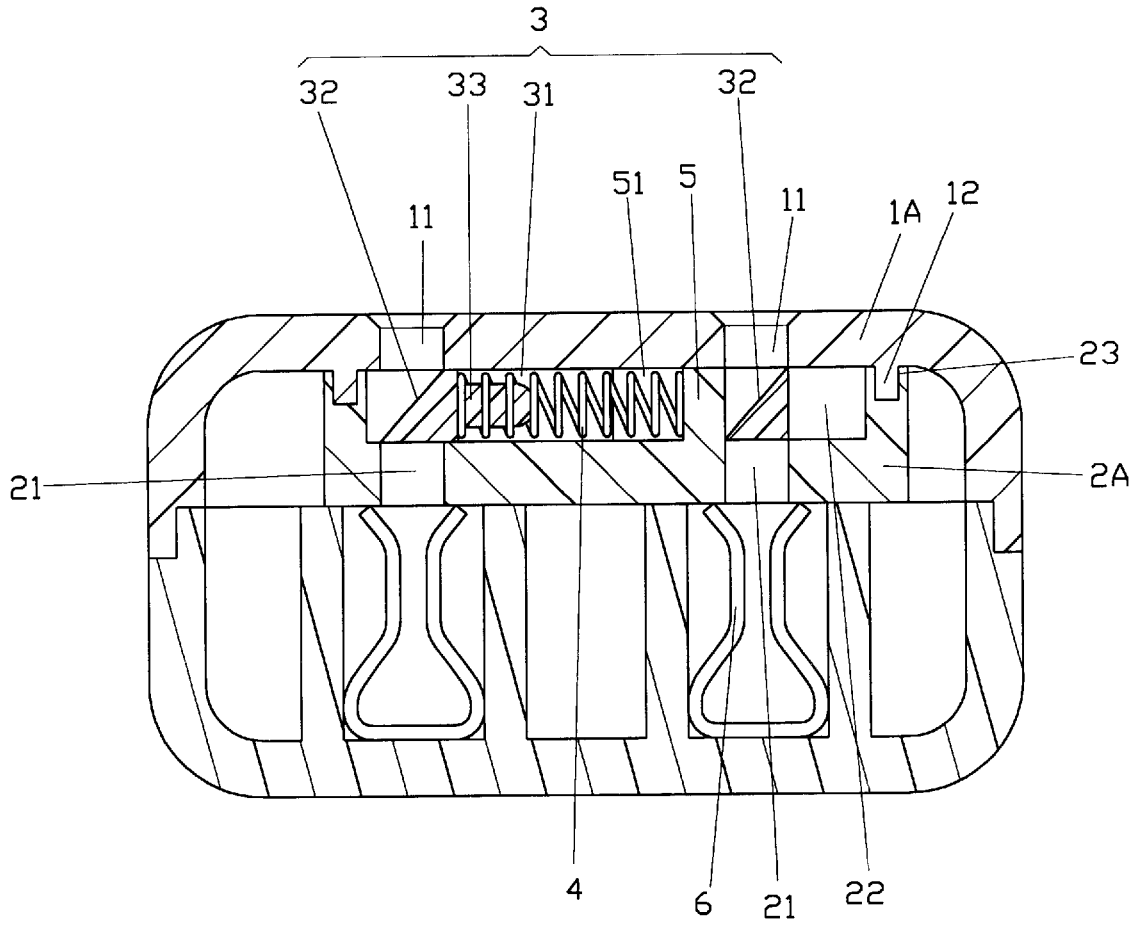
FIG. 2 is a schematic view of a first preferred embodiment of the present invention assembled with a matching plug receptacle.
Figure 3:
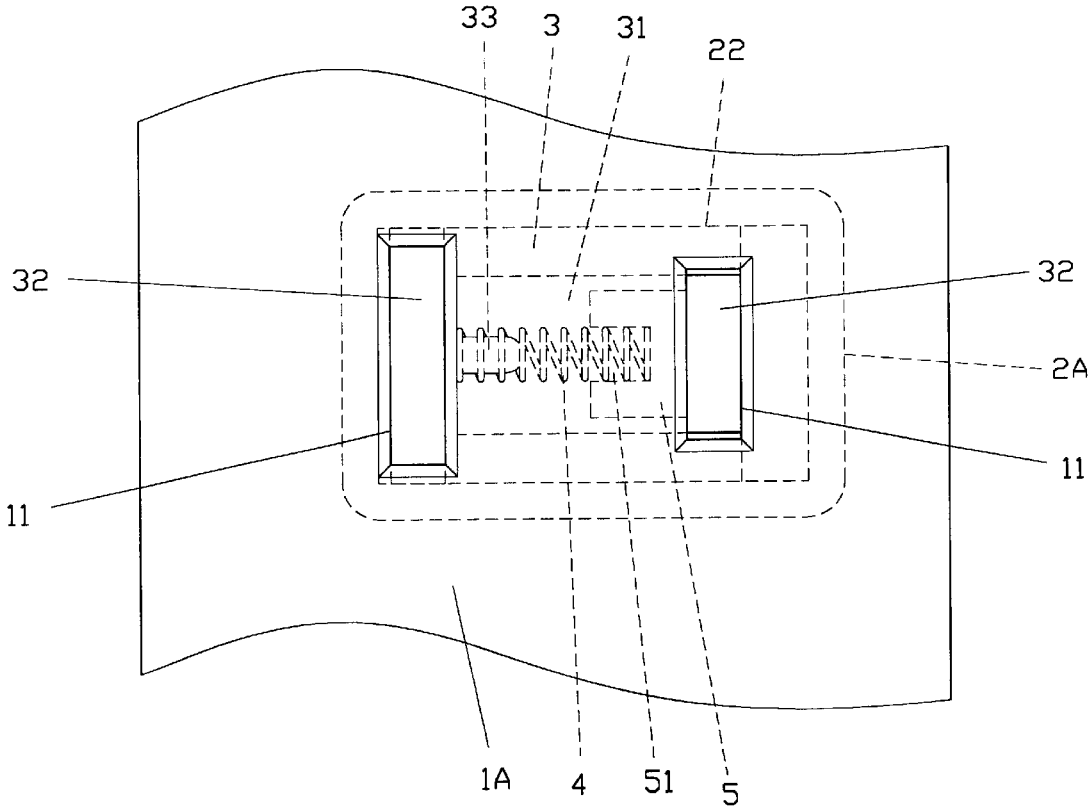
FIG. 3 is a top view of an assembly of the first preferred embodiment of the present invention.

With the configuration disclosed above, the first embodiment of the present invention is illustrated in FIG. 2. The intermediate space of a lower base (2A) containing the saddle (5), the cover (3) and the flexible element (4) is assembled to the bottom of the two outlets (11) of the upper lid (1A) by means of holes (23) and tenons (12). The intermediate space is located above the two conductive plates (6) inside the plug receptacle having the two secondary outlets (21) of the lower base (2A) corresponding to the two conductive plates (6). Referring to FIG. 3, an assembly of the first preferred embodiment containing the flexible element (4) and the saddle (5) in the cover (3) to secure in place is compact in structure slightly longer than that of the spacing between two outlets (11) and the holes. It is ideal to be applied in compact receptacle products. Before receiving the insertion of a plug, the cover (3) is pushed by the flexible element (4) and remains against one side of the intermediate space. The slopes (32) on both sides of the cover (3), therefore, are restricted by the outlets (11) of the upper lid (1A) to fend off ingression of dust.

Figure 4:
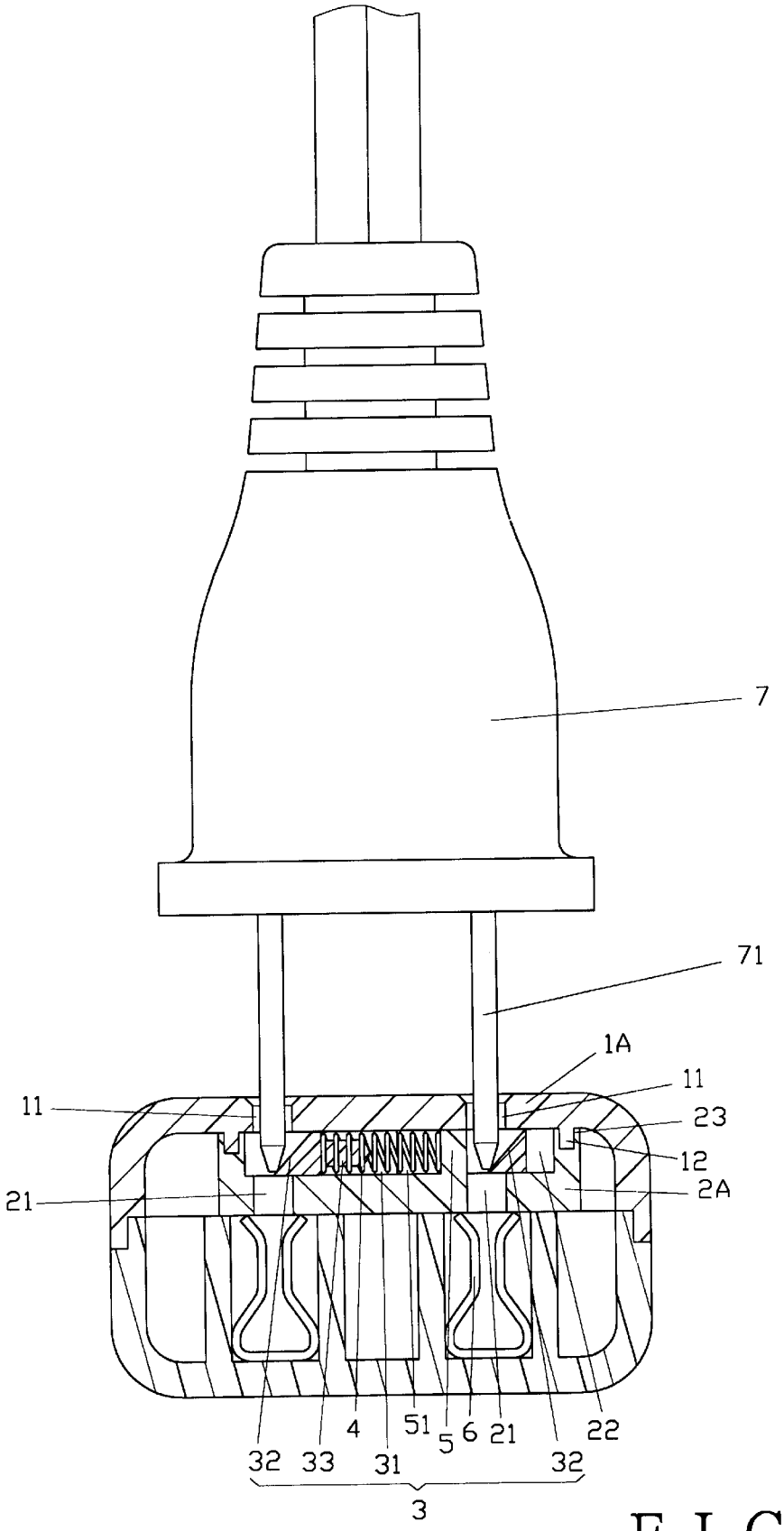
FIG. 4 is a schematic view showing a plug is inserted into the first preferred embodiment of the present invention.
Figure 5:
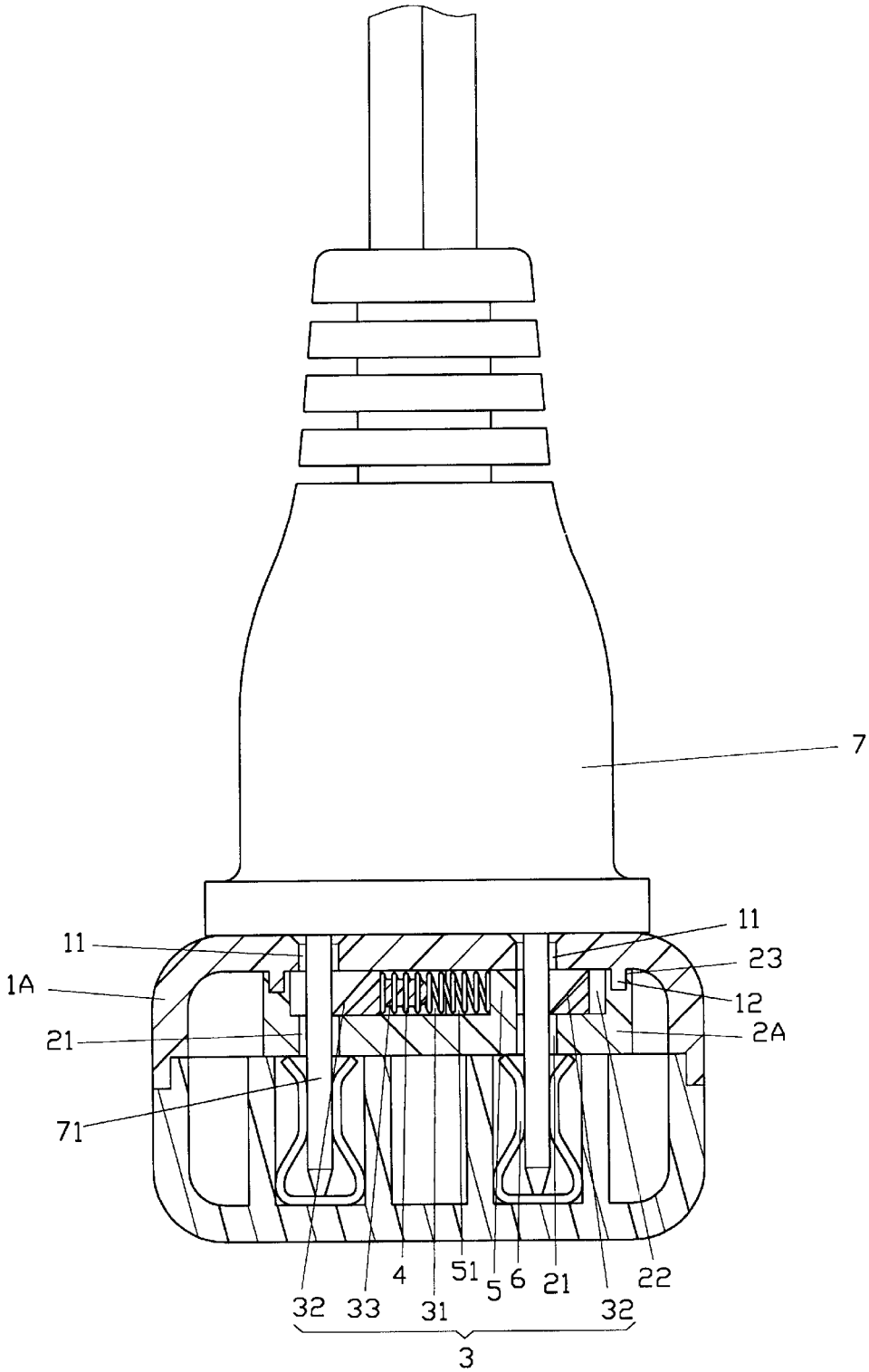
FIG. 5 is another schematic view showing the plug inserted into the first preferred embodiment of the present invention.
Figure 6:
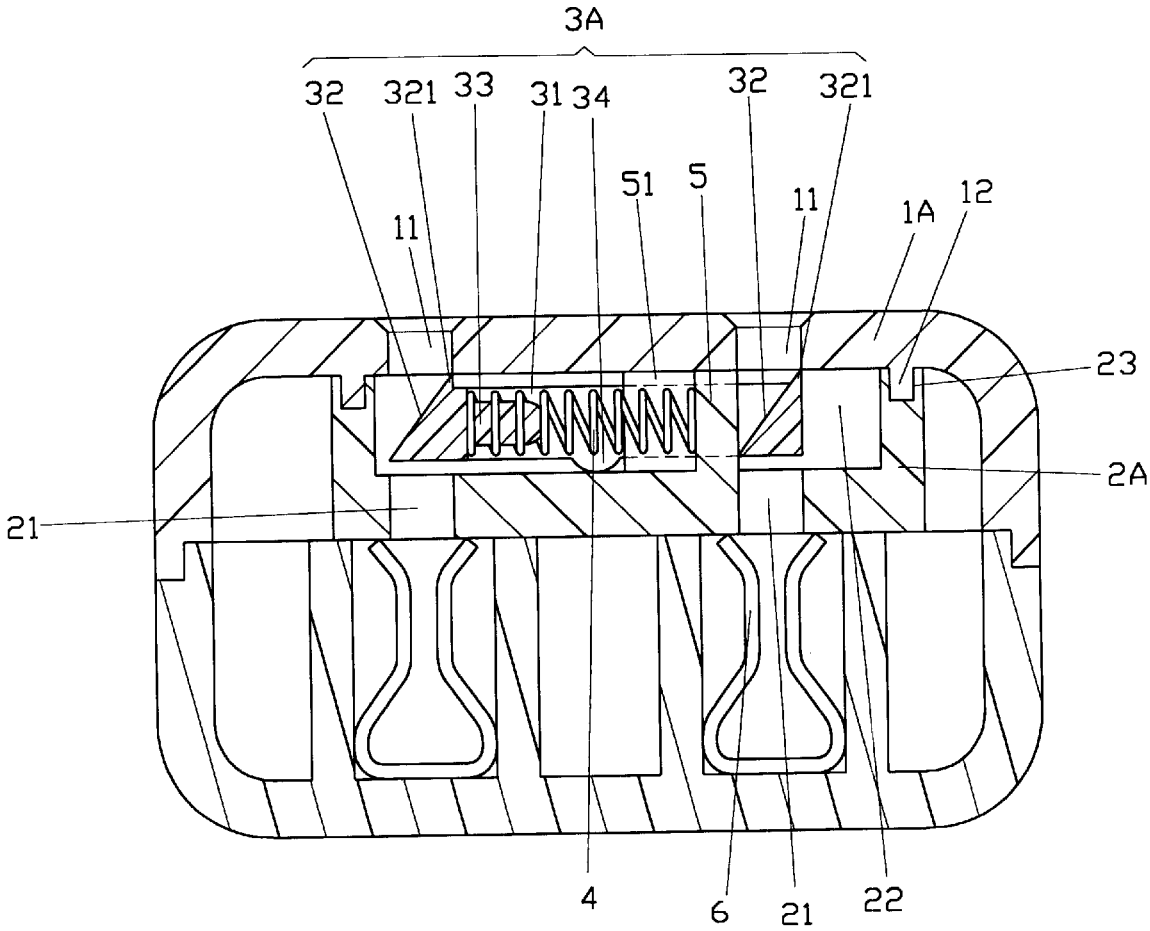
FIG. 6 is a schematic view showing a second preferred embodiment of the present invention with the protection cover in another configuration.

Furthermore, as illustrated in FIGS. 4 and 5, when a plug (7) is inserted with its two pins (71) into the outlets (11) of the upper lid (1A), the slopes (32) of the cover (3) are pushed by the pins (71) to cause the cover (3) to slide laterally. The cover (3) then applies a balanced compression against the flexible element (4) in the intermediate space for the cover (3) to slide smoothly, thus, clearing the slopes (32) away from the outlets (11) to allow the pins (71) to be received by the conductive plates (6).

Figure 7:
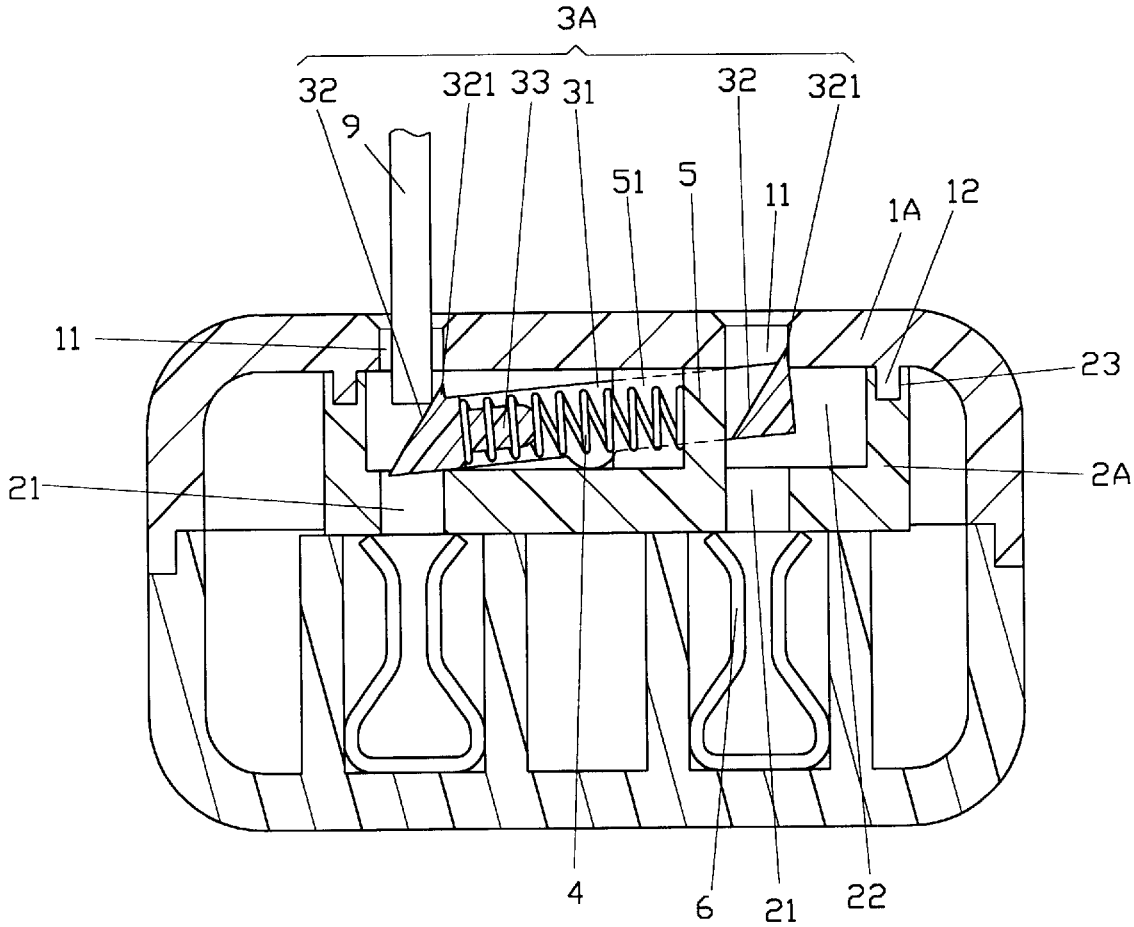
FIG. 7 is a schematic view showing the operation of the protection cover of the second preferred embodiment of the present invention.
Figure 8:
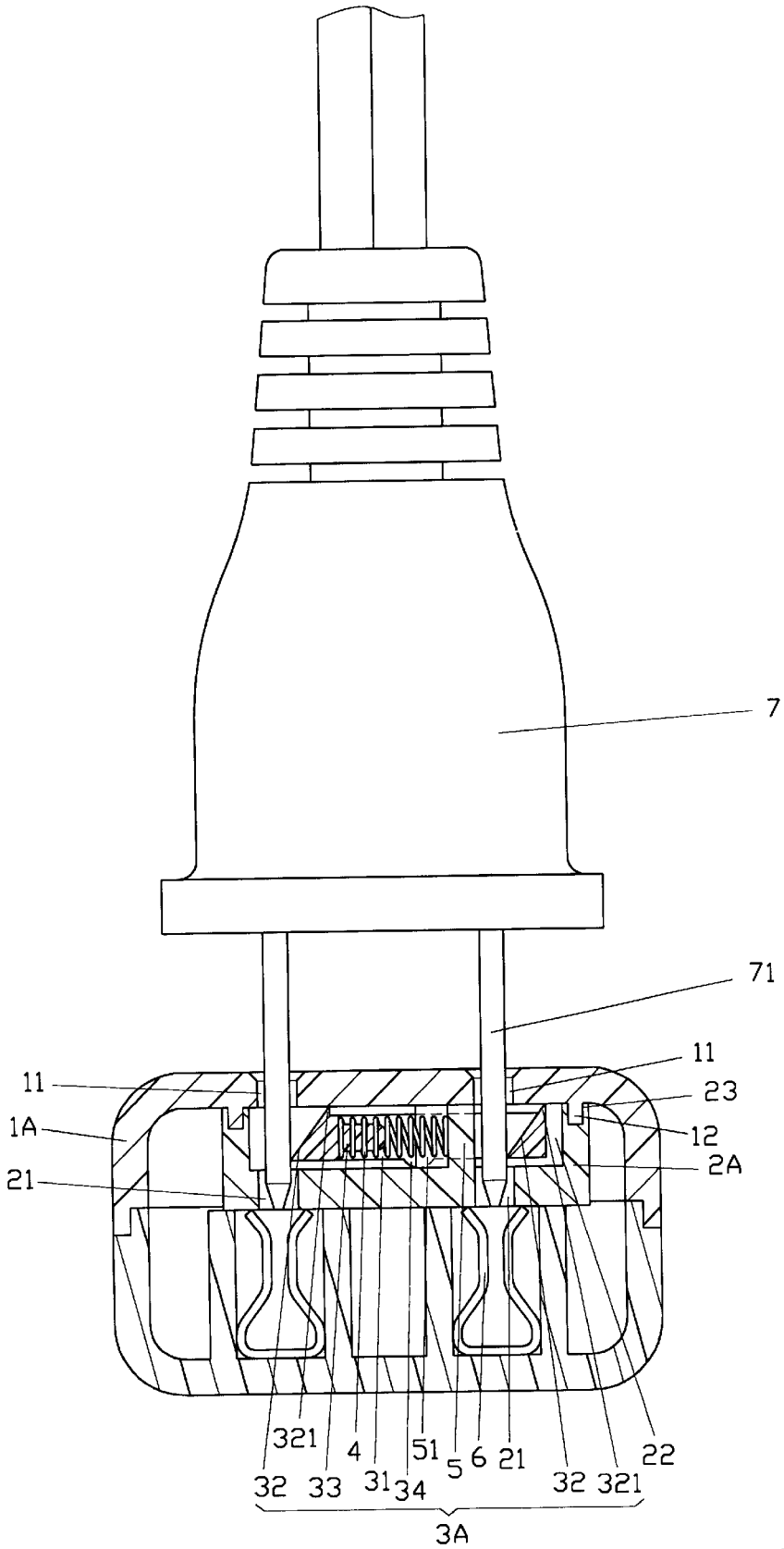
FIG. 8 is a schematic view showing a plug is inserted into the second preferred embodiment of the present invention.

To prevent an electrical shock caused by a foreign matter (9) entering into one of the outlets (11), in a second preferred embodiment of the present invention, a convex portion (34) holding against the bottom of the intermediate space is provided in the center of the protective cover (3A). The convex portion (34) creates a support to form an inclined leverage for the protective cover (3A), which in turn contains at least one side slope (32) extending beyond the cover (3A) to form an outer bulge (321). As illustrated in FIG. 7, the foreign matter (9) enters into the outlet (11) and holds against one side of the cover (3) to cause the cover (3) to incline with the outer bulge (321) on the slope (32) rising to hold against the outlet (11). Consequently, the outer bulge (321) prevents the cover (3A) from traveling laterally to leave the outlet (11) and the secondary outlet (21), thus preventig further insertion of the foreign matter (9). As illustrated in FIG. 8, when both pins (71) of the plug (7) are inserted into the two outlets (11) at the same time to push against the slopes (32) of the cover (3A), the cover (3A) travels laterally to compress the flexible element (4) in the intermediate space for the slopes (32) to clear away from the outlets (11) and the secondary outlets (21), This allows the pins (71) to be easily received by the conductive plates (6).

Figure 9:
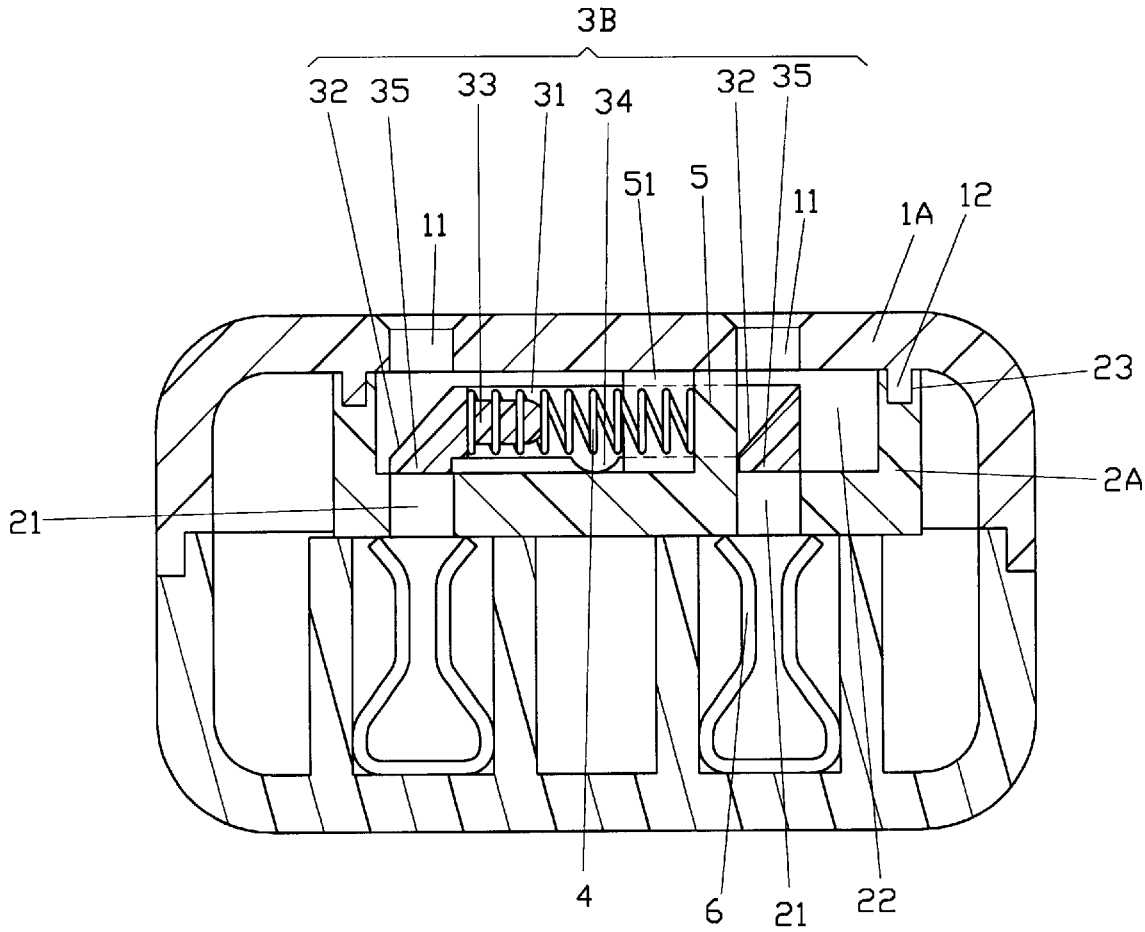
FIG. 9 is a schematic view showing a third preferred embodiment of the present invention with the protection cover in another configuration.
Figure 10:
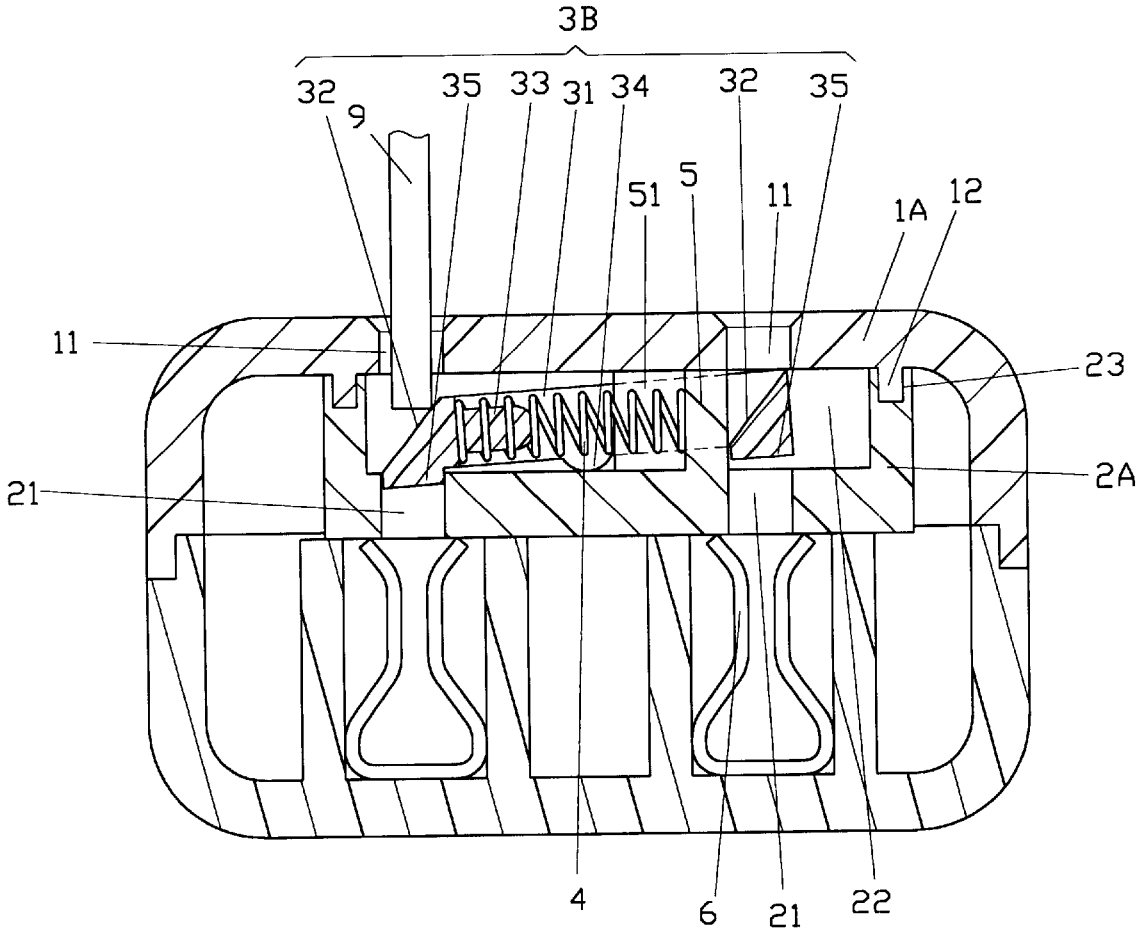
FIG. 10 is a schematic view showing the operation of the protection cover of the third preferred embodiment of the present invention.
Figure 11:
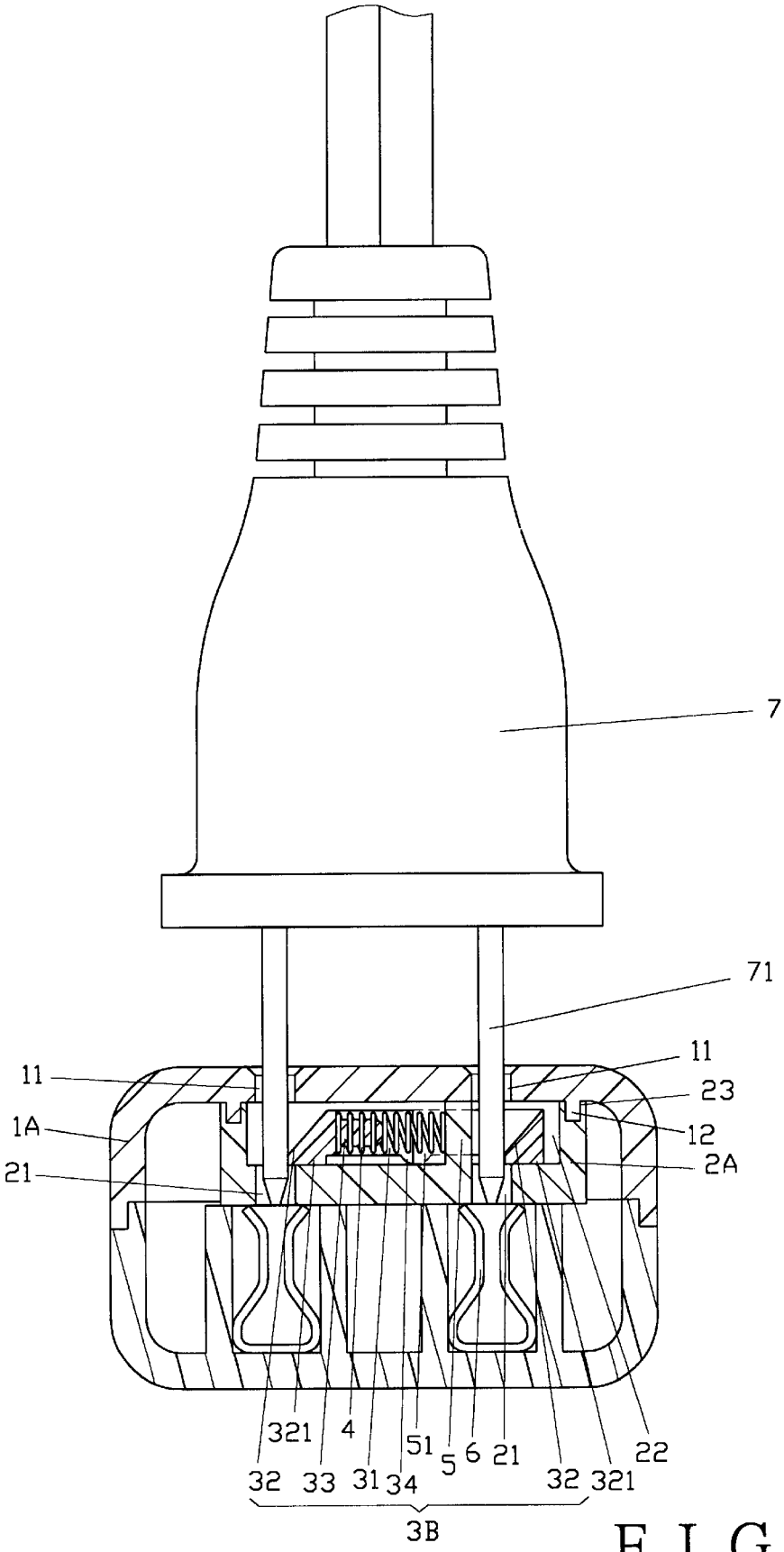
FIG. 11 is a schematic view showing a plug is inserted into the third preferred embodiment of the present invention.

In addition to the convex portion (34) holding against the bottom of the intermediate space in the center of a protection cover (3B), in a third preferred embodiment of the present invention as illustrated in FIG. 9, at least one stopper (35) is provided on the lower edge of the cover (3A) corresponding to the secondary outlet (21). The cross-sectional area of the stopper (35) is smaller than that of the secondary outlet (21) so that when the cover (3B) inclines due to insertion of the foreign matter (9), as illustrated in FIG. 10, the stopper (35) rises to block the secondary outlet (21) to prevent the cover (3B) from traveling laterally to clear away from the outlet (11) and the secondary outlet (21). This prevents further insertion by the foreign matter (9). When both pins (71) of the plug (7) are inserted into the outlets (11) and hold against the slopes (32) of the cover (3B), as illustrated in FIG. 11, the cover (3B) slides laterally to compress the flexible element (4) for the slopes (32) to clear away from the outlets (11) and the secondary outlets (21). Consequently, the pins (71) can be easily received by the conductive plates (6).

Figure 12:
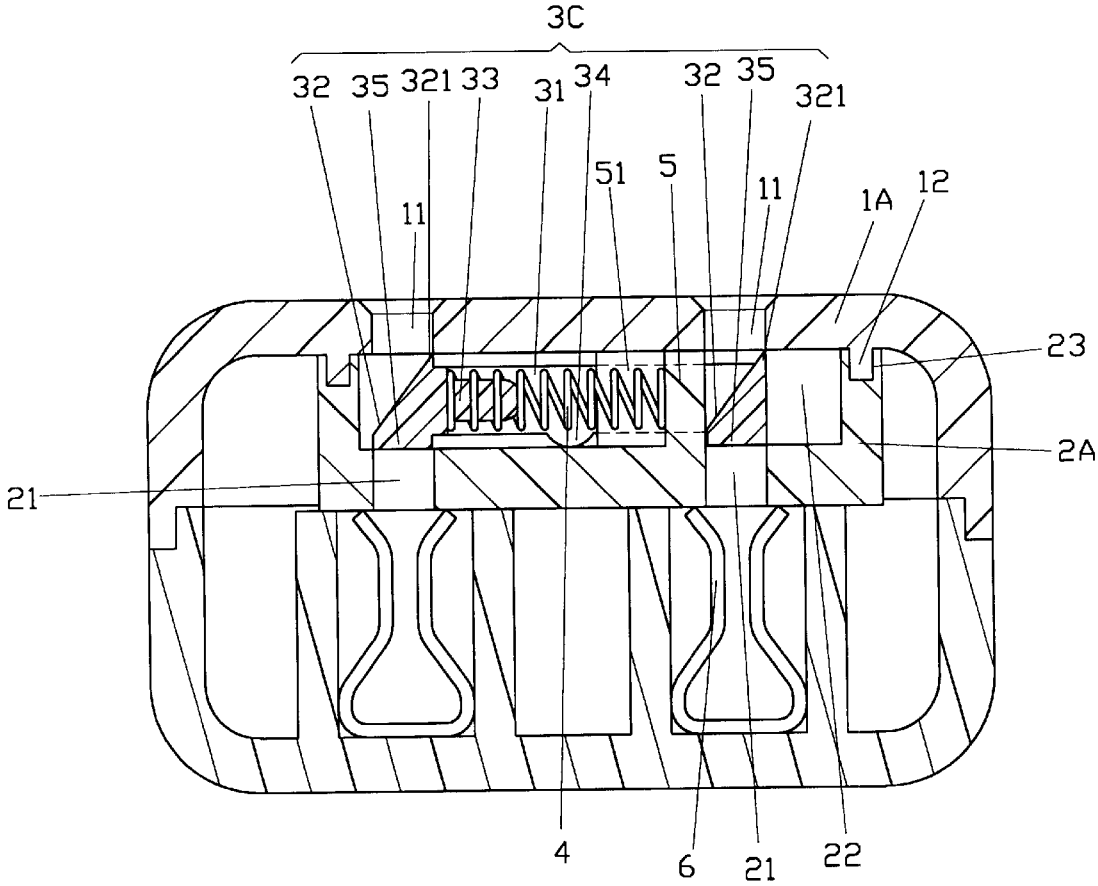
FIG. 12 is a schematic view showing a fourth preferred embodiment of the present invention with the protection cover in another configuration.
Figure 13:
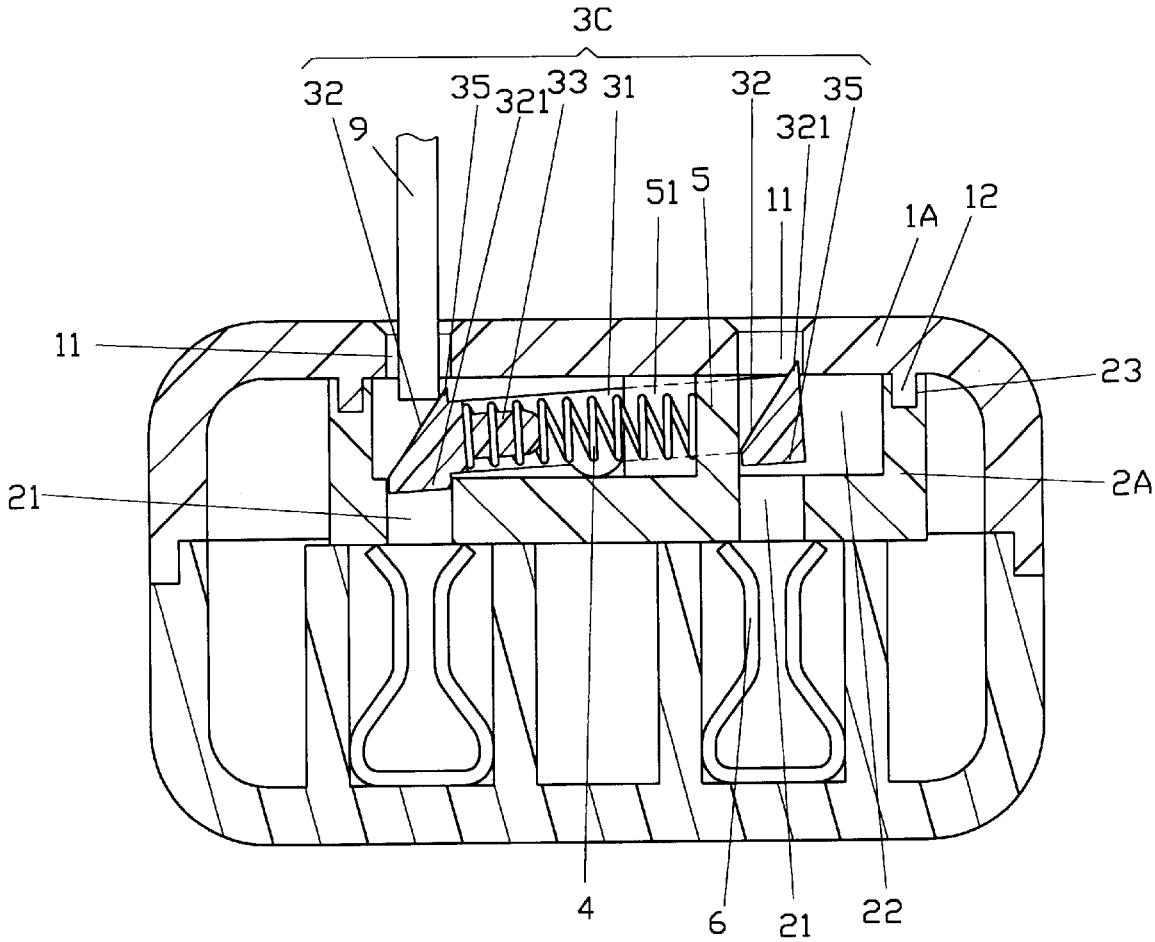
FIG. 13 is a schematic view showing the operation of the protection cover of the fourth preferred embodiment of the present invention.
Figure 14:
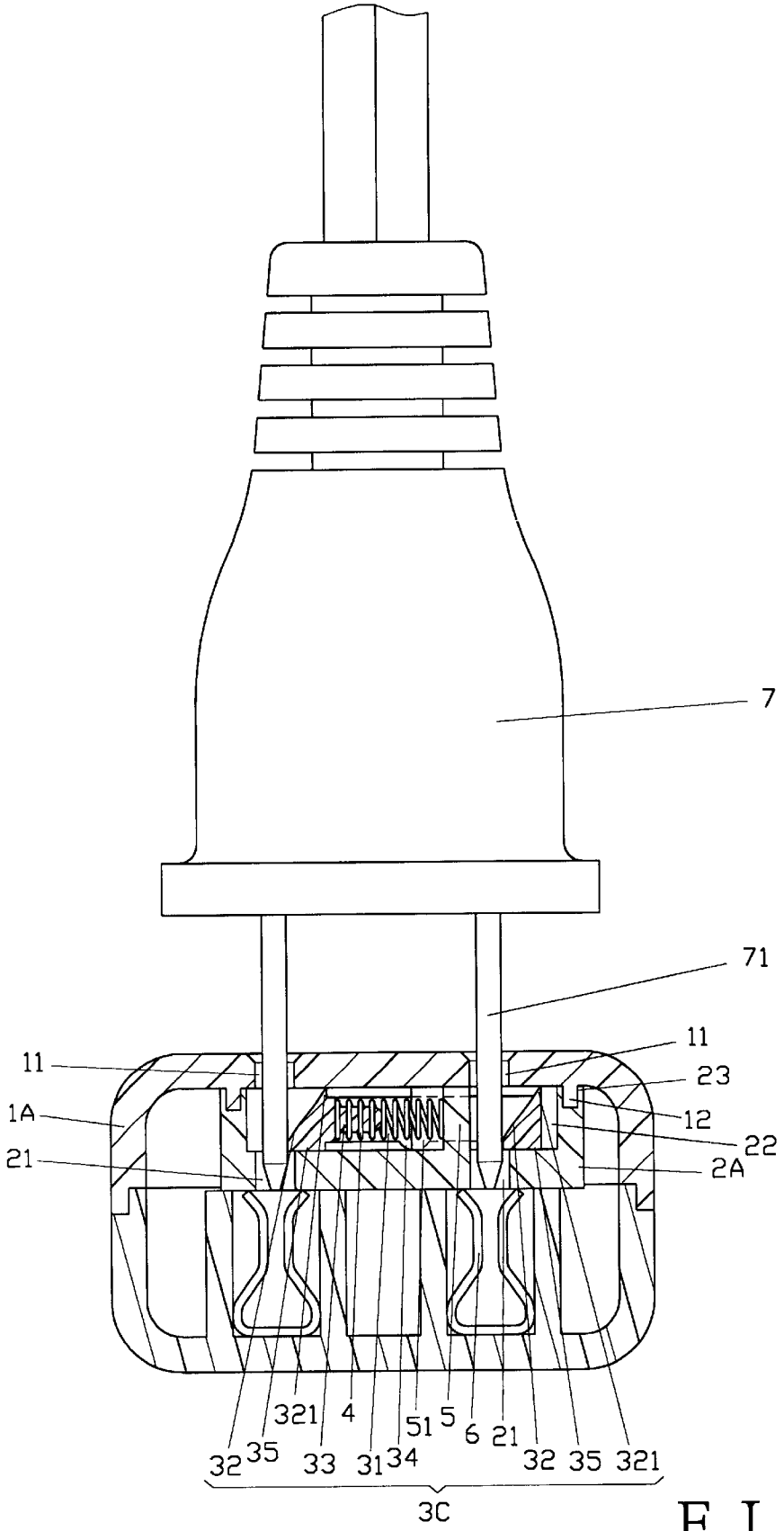
FIG. 14 is a schematic view showing a plug is inserted into the fourth preferred embodiment of the present invention.

Now referring to FIG. 12, in a fourth preferred embodiment of the present invention, the same convex portion (34) is provided in the center at the bottom of a protection cover (3C), the outer bulge (321) to the slope (32) of the cover (3C) and the stopper (35) at the lower edge of the cover (3C) with its cross-sectional area smaller than that of the secondary outlet (21). Once the cover (3C) inclines, as illustrated in FIG. 13, the insertion of a foreign matter (9) into a single outlet (11), extends the outer bulge (321) from the slope (32) of the cover (3C) and the stopper (35) at the lower edge of the cover (3C) respectively to hold against the outlet (11) above and the secondary outlet (21) below, preventing the cover (3C) from slliding laterally. When both pins (71) of the plug (7) are simultaneously inserted into the outlets (11) to push against the slopes (32) of the cover (3C), as illustrated in FIG. 14, the cover (3C) slides laterally to compress the flexible element (4) for the slopes (32) to clear away from the outlets (11) and the secondary outlets (21), allowing the pins (71) to be further received in place by the conductive plates (6).

Figure 15:
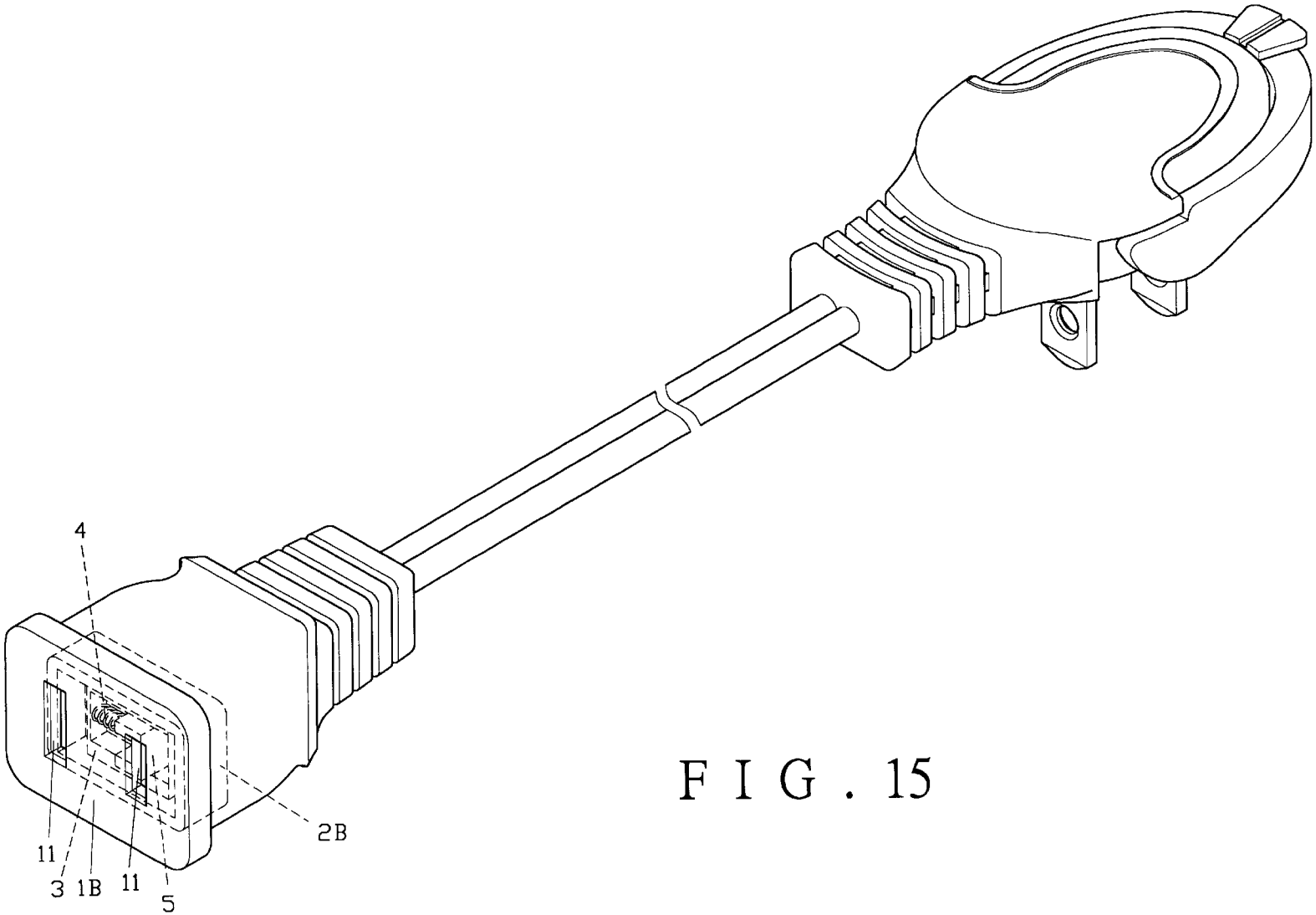
FIG. 15 is a schematic view of a fifth preferred embodiment of the present invention operating with a one-on-one extension receptacle.
Figure 16:
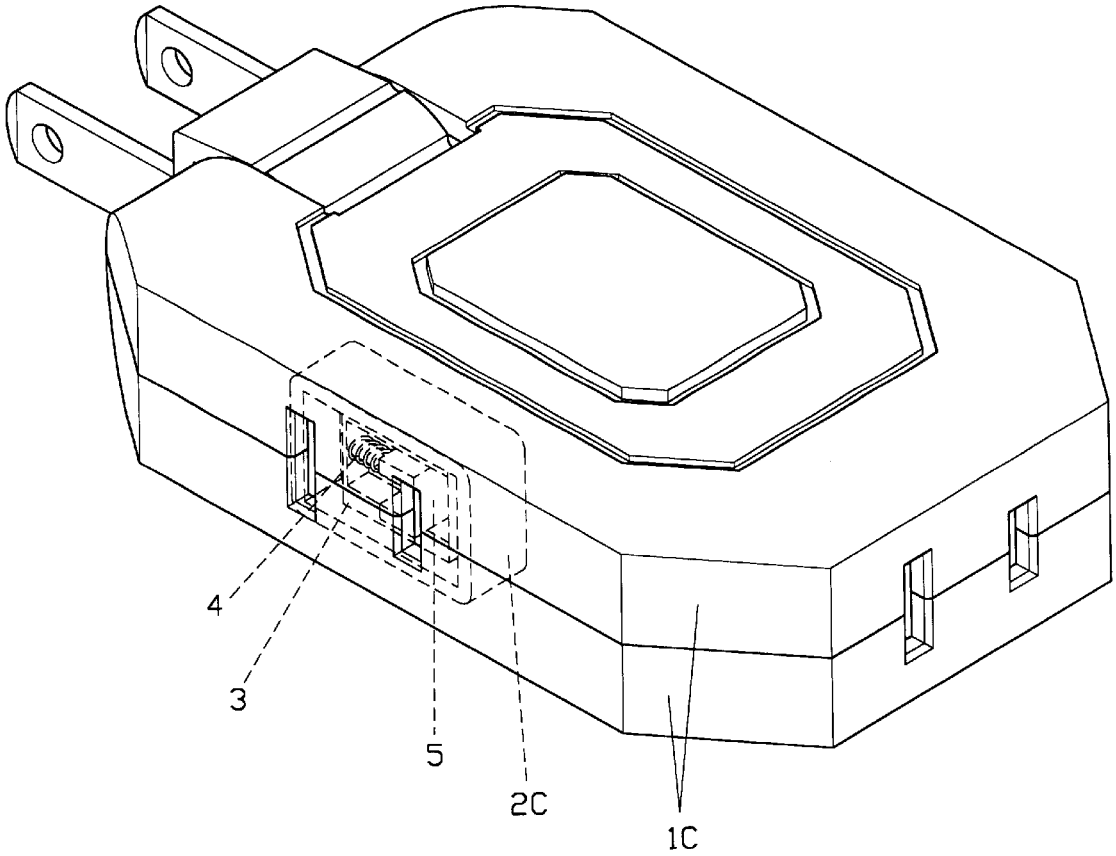
FIG. 16 is a schematic view showing a sixth preferred embodiment of the present invention operating with a one-on-three extension receptacle.

By including a mini-plug generally available in the market, an assembly comprised of the protective cover (3) containing the flexible element (4) and the saddle (5) for positioning purpose, as illustrated in FIG. 15, a fifth preferred embodiment of the present invention relates to a one-on-one extension product that can be added to the plug receptacle outlets (11) without changing the size of the mini-plug. That is, the present invention including the cover (3), an upper lid (1B), a lower base (2B), the flexible element (4) and the saddle (5) can be added to the mini-plug without increasing the sectional area of the outlets (11), so that the appearance of the extension plug remains slim. As illustrated in FIG. 16, a sixth preferred embodiment of the present invention is applied to a one-on-three extension plug. Here, the flat and thin base of the plug also has sufficient space to accommodate the present invention comprised of the cover (3), an upper lid (1C), a lower base (2C), the flexible element (4) and the saddle (5). Naturally, in meeting requirements of being compact for the general extension receptacle, floor type or wall-mounted type, the present invention offers an optimal option.

Figure 17:
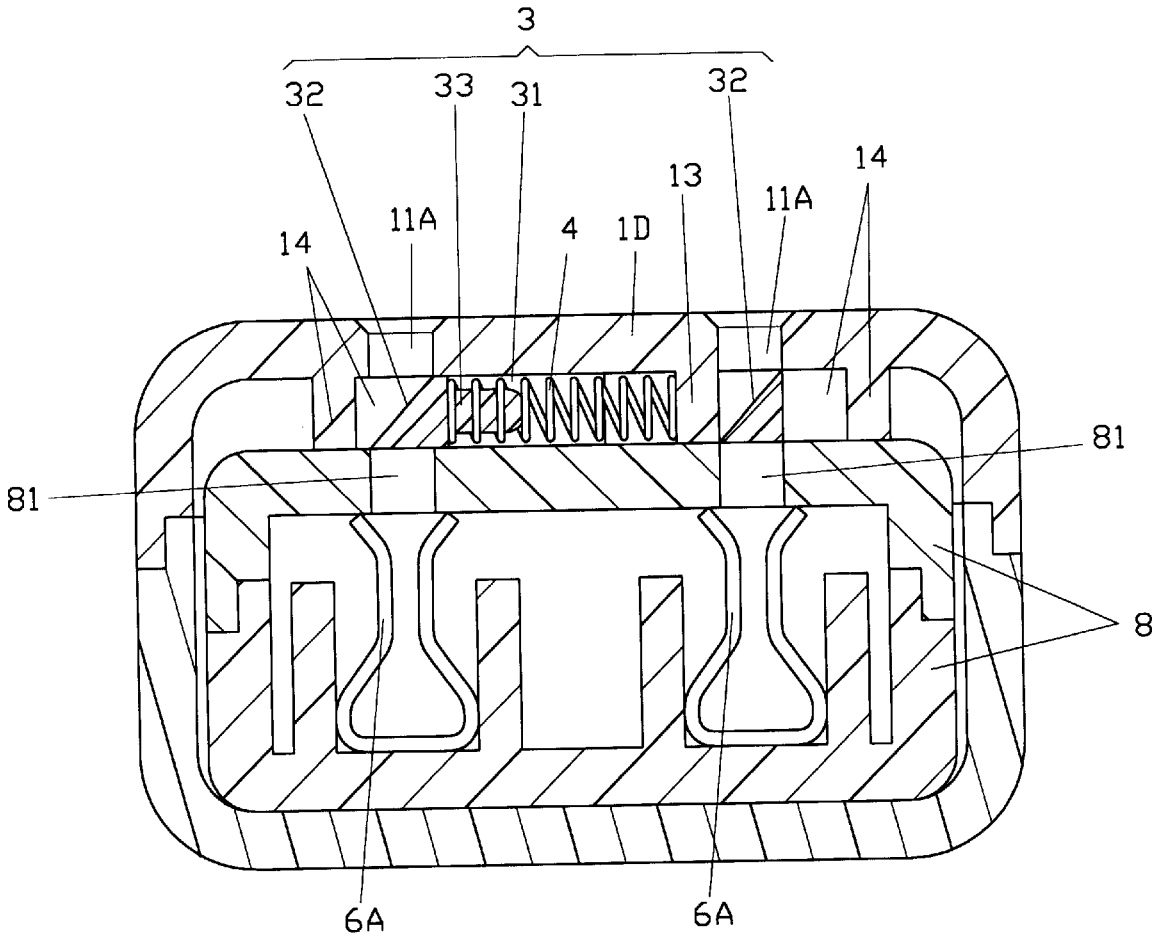
FIG. 17 is a view showing another arrangement of an intermediate space of a seventh preferred embodiment of the present invention.
Figure 18:
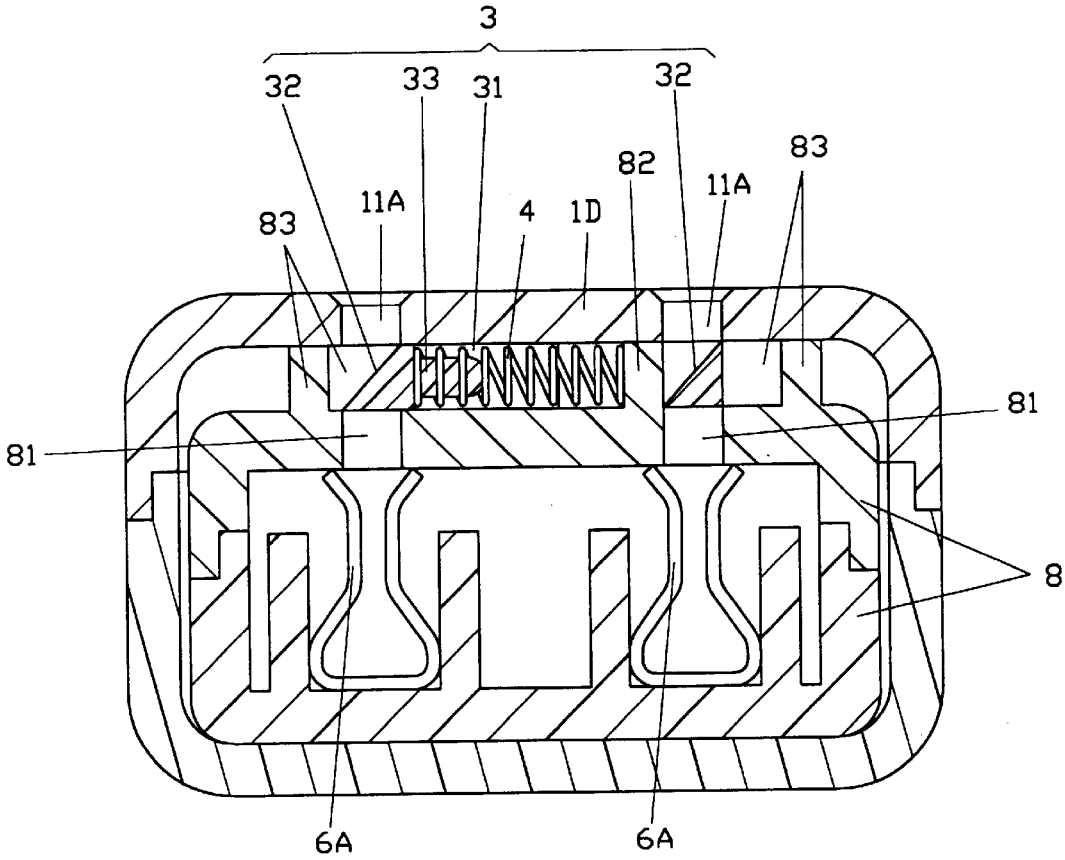
FIG. 18 is a view showing another arrangement yet of an intermediate space of an eighth preferred embodiment of the present invention.

Furthermore, there are many ways for the configuration of the intermediate space disclosed in those preferred embodiments of the present invention. As illustrated in FIG. 17, a seventh preferred embodiment of the present invention has its members including a saddle (13) and a guide slope (14) integrated at the bottom of an upper lid (1D) while an inner base (8) is provided inside the receptacle. Conductive plates (6A) are fixed in the inner base (8) with secondary outlets (81) provided on the upper surface of the inner base (8) corresponding to outlets (11A) in the upper lid (1D). Here, the saddle (13) and the guide slopes (14) of the upper lid (1D) are held against the upper surface of the inner base (8) to form the intermediate space. Additionally to the secondary outlets (81), a saddle (82 ) and guide slopes (83) are also integrated on the upper surface of the inner base (8) to hold against the bottom of an upper lid (1D) to form the intermediate space in an eighth preferred embodiment of the present invention as illustrated in FIG. 18.

Figure 19:
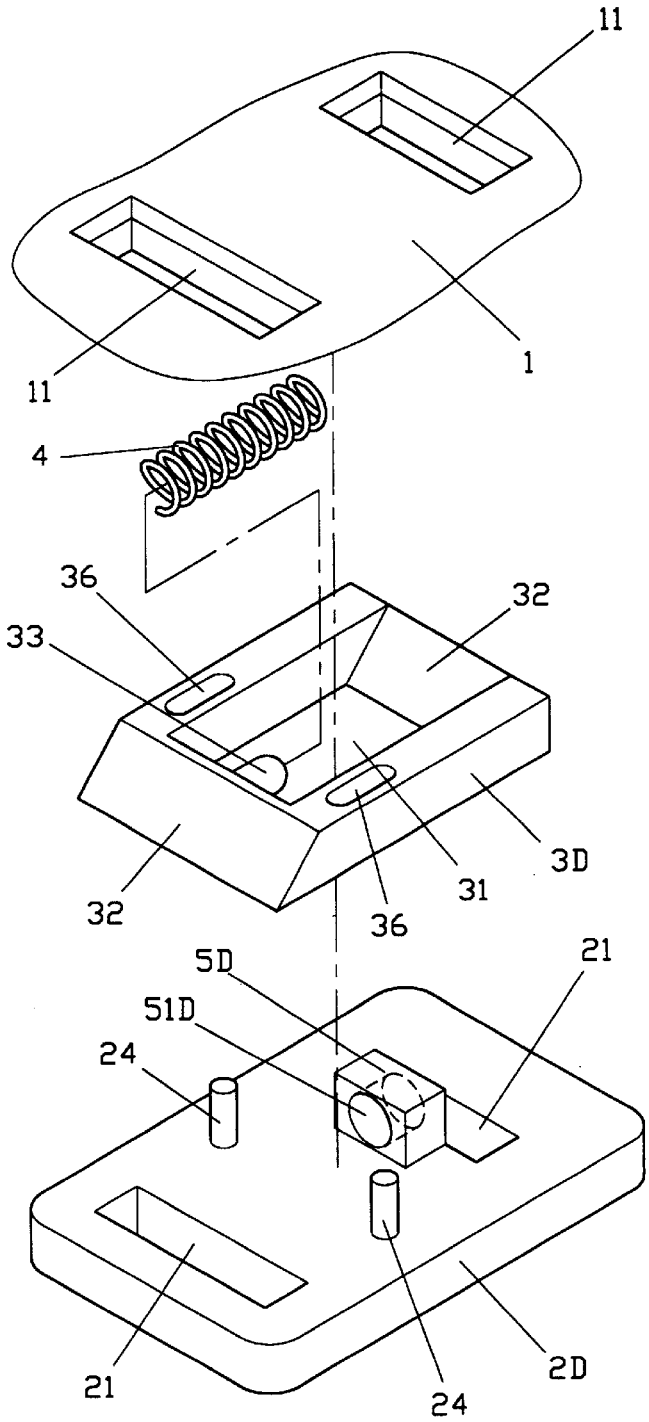
FIG. 19 is a view showing a changed arrangement of a guide of a ninth preferred embodiment of the present invention.

The portion provided in the intermediate space to guide lateral movement of the protective cover of the present invention can be executed by the edge of the saddle (5) or the slopes (22) on both sides of the intermediate space in parallel with the sides of the protective cover (3) as disclosed above (refer to the preferred embodiment illustrated in FIG. 1), other ways are feasible to achieve the same purpose. As illustrated in FIG. 19, two guide slots (36) are provided on a protective cover (3D) while two corresponding posts (24) are provided on a lower base (2D) or on an upper lid (1) to form a guide portion for a cover (3D) by having inserted the posts (24) into the guide slots (36) in a ninth preferred embodiment of the present invention. Of course, in this preferred embodiment, both of thge posts (24) and the guide slots (36) can be exchanged for their locations, and a saddle (5A) in the lower base (2D) is not necessarily to hold against the cover (3D), and thus, to achieve greater compactness for the receptacle protective case (3D) while a hole (51) is made in a circular concave to connect to the end of and fix the flexible element (4).

In summary, the present invention provides the following advantages:

1. Having the least cross-sectional space of the outlet and the least depth of the outlet to construct the protective cover for a plug receptacle. That is, a minimum intermediate space (approximately in thickness of 1~2 mm) is sufficient.
2. Having the flexible element provided in the intermediate space to provide a sensitive and balanced flexibility to facilitate the sliding by the protective cover, and
3. Having a single piece protection cover and the flexible element contained in the intermediate space to allow easy assembly.

Furthermore, the free length of the flexible element (4) is smaller than that between the two outlets (11) so that even if the flexible element (4) falls off during the course of use, it will not cause a shortage by contacting the said two pine (71) of the plug (7).

I claim:

1. A plug receptacle protection cover including a spring element, a receptacle containing at least two outlets, an intermediate space provided at the bottom of said outlets of said receptacle having a protective cover defining a pair of opposing sloped sides, two secondary outlets provided at the bottom of said intermediate apace in alignment with said outlets, characterized by a saddle provided in said intermediate space between said two outlets, a perforated portion formed within said protective cover, said spring element provided between said saddle and said protective cover, and a guide portion provided inside said intermediate space to guide travel of said protective cover; and a convexly contoured element protruding from a bottom of said protective cover to cause said protective cover to incline said protective cover when an external element is inserted into only one of said outlets thereby preventing said protective cover from sliding in a lateral direction.

2. A plug receptacle protection cover as recited in claim 1, wherein said saddle and protective cover are each provided with a trough or protrusion contiguously contact two ends of said spring element.

3. A plug receptacle protection cover as recited in claim 1, wherein the length of said spring element is less than the distance between said two outlets.

4. A plug receptacle protection cover as recited in claim 1, wherein said guide portion is defined by an edge of said saddle.

5. A plug receptacle protection cover as recited in claim 1, wherein said guide portion is defined by said opposing sloped sides formed along both sides of said intermediate space in parallel with and bearing against both sides of said protective cover.

6. A plug receptacle protection cover as recited in claim 1, wherein the length of a longer side of said protective cover is approximately equal to a distance between twoouter edges of said two outlets.

7. A plug receptacle protection cover as recited in claim 1, wherein at least one stopper protrudes from a lower edge of said protective cover which is aligned with said secondary outlet having a cross-sectional area of said stopper less than that of said secondary outlet so as to be restricted to said secondary outlet when said protective cover is inclined.

8. A plug receptacle protection cover as recited in claim 1, wherein said convexly contoured element is located in the center at the bottom of said protective cover to hold the bottom of said intermediate space to provide inclined leverage, at least one slope of said protective cover having a bulge on the upper surface of said protective cover, and at least one stopper with its sectional area less than that of said secondary outlet is provided at the lower edge of said protective cover which is aligned with said secondary outlet so that both said bulge of said slope and said stopper respectively hold against said outlets above and said secondary outlets below said protective cover.

* * * * *